United States Patent [19]

Hawkins

[11] 4,387,841

[45] Jun. 14, 1983

[54] FILM DIVERSION APPARATUS

[75] Inventor: William E. Hawkins, Circleville, Ohio

[73] Assignee: E. I. Du Pont de Nemours and Company, Wilmington, Del.

[21] Appl. No.: 252,520

[22] Filed: Mar. 20, 1981

[51] Int. Cl.[3] ..... B65H 17/32

[52] U.S. Cl. ..... 226/97

[58] Field of Search ..... 226/5, 7, 95, 97, 91, 226/110; 34/156 R

[56] References Cited

U.S. PATENT DOCUMENTS

| | | | |
|---|---|---|---|
| 3,762,250 | 10/1973 | Huskey | 83/27 |
| 3,764,085 | 10/1973 | Hawkins | 242/56.6 |
| 4,014,487 | 3/1977 | Reba et al. | 226/5 |
| 4,144,618 | 3/1979 | Campo et al. | 19/161.1 |

*Primary Examiner*—Leonard D. Christian

[57] ABSTRACT

An apparatus for diverting a wide, continuously advancing film. The apparatus includes a first jet device for forwarding a broken film from the tenter oven to a second jet device which, in turn, routes the film to waste with no reduction in line speed.

8 Claims, 10 Drawing Figures

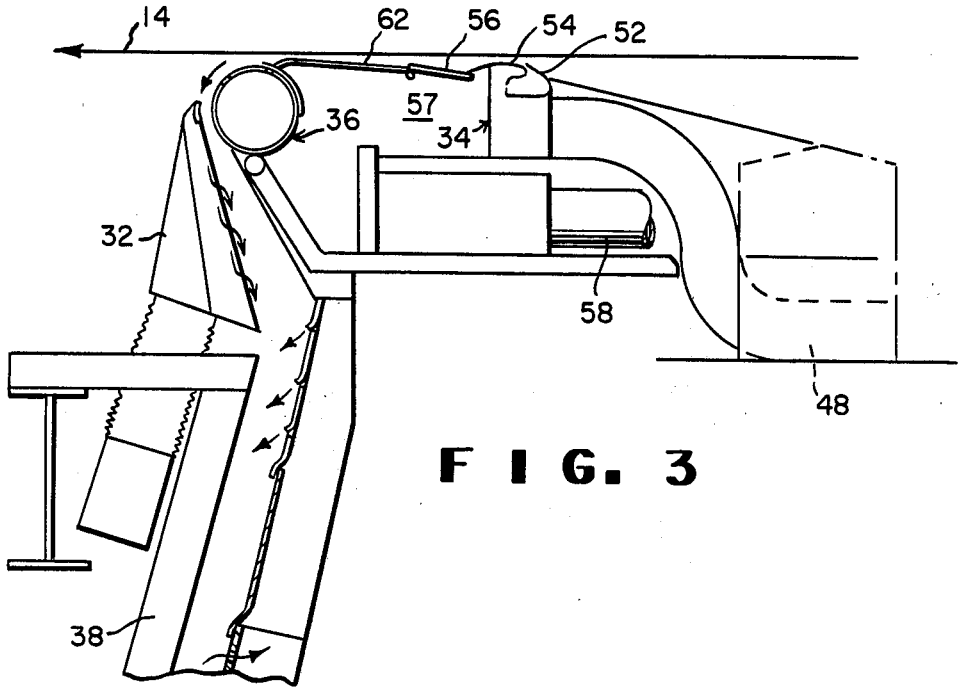
FIG. 3
FIG. 4
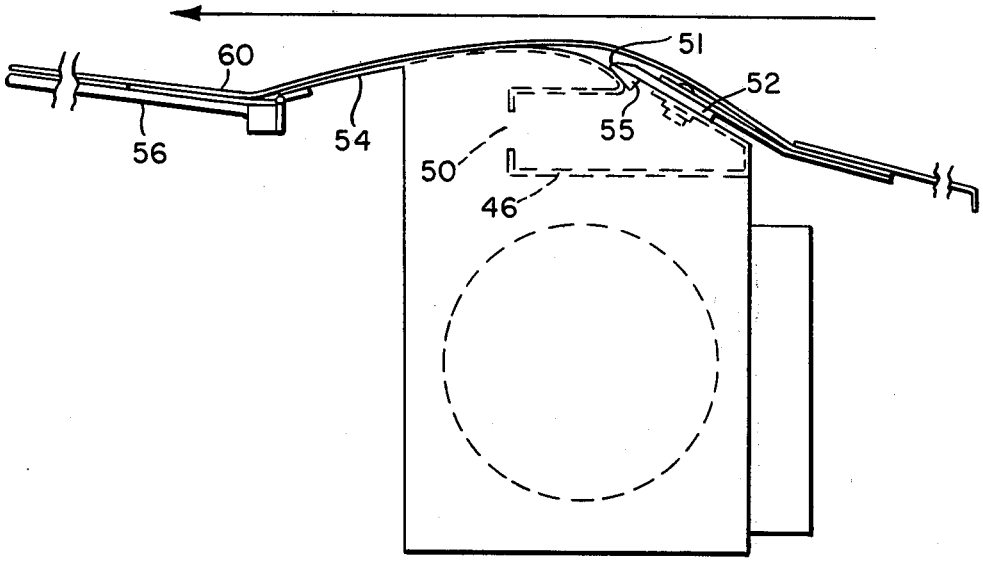

FILM DIVERSION APPARATUS

BACKGROUND

This invention relates, generally, to the manufacture of thin films and, more particularly, to a semi-automatic apparatus for diverting a continuously advancing, broken film to waste.

In existing machines, film is manufactured by extruding a web of molten, polymeric, film-forming materials onto a quench wheel and then advancing the web through stretching and slitting stations to one or more windups. Equipment for cutting and diverting the stretched film in the event of a discontinuity between its beads or edges has been disclosed by Huskey in U.S. Pat. No. 3,762,250. The film is diverted to a waste shredder until the discontinuity has been healed. Even though the equipment is normally effective, there are still situations in which a discontinuity can cause entanglements. Such entanglements, in turn, cause broken beads or wrapping of the film on transfer rolls, in which events there is a stoppage of film to the waste shredder and an accumulation at the exit of the stretching station. Stretched film also accumulates if, for any reason, the waste shredder system is inoperable. Whenever continuity is lost to the waste shredder, the casting line speed is reduced to facilitate manual handling of the accumulated waste. Speed can be reduced rapidly or below a certain level only at the risk of a burn-through in the stretching station. At the same time, if speed is not reduced sufficiently, difficulties are encountered by the operators who must handle the accumulated waste. But for the need to reduce speed for stoppages due to breaks and entanglements, the throughput of all existing machines could be increased appreciably.

SUMMARY

The above and other difficulties have been avoided by providing, in film-handling equipment, an elongated Coanda jet beneath the normal path of advance for film. The jet is mounted for rotation between a first position where it attracts and diverts a broken film and a second portion where it advances the film to waste. Another elongated jet, located beneath the film path, attracts and forwards a broken film to the diverting jet.

DRAWINGS

FIG. 3 is an enlarged view of the forwarding and diverting apparatus shown in FIG. 1.

FIG. 4 is a further enlargement of the forwarding apparatus shown in FIGS. 1 and 3.

DESCRIPTION

Figure 1:
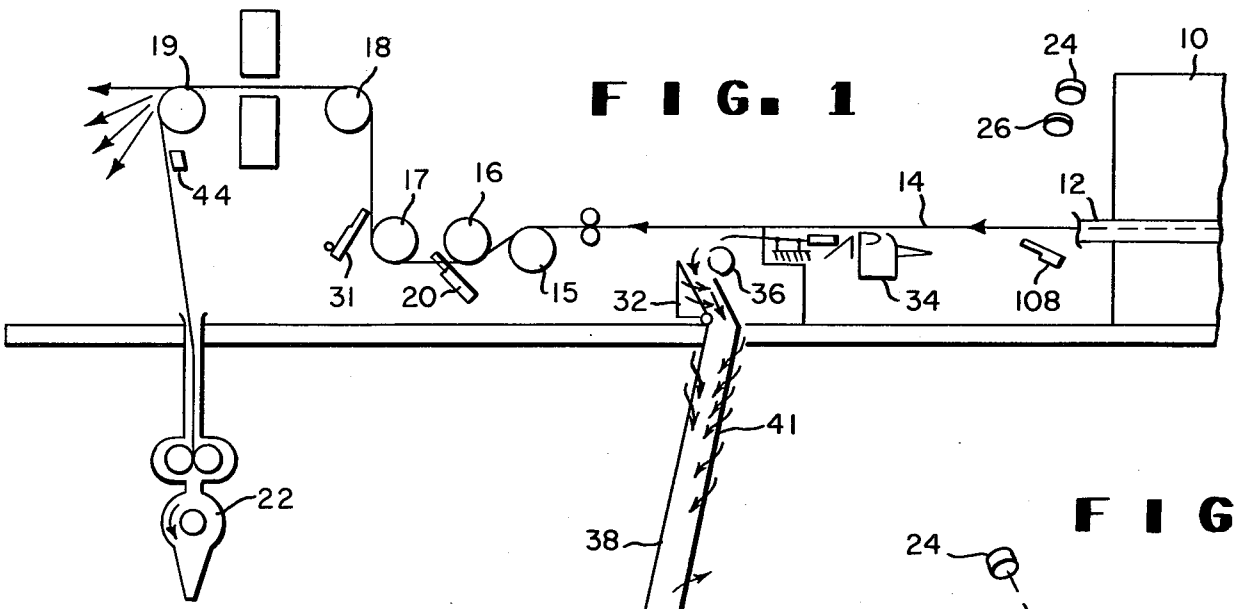
FIG. 1 is a schematic illustration of the apparatus of the present invention and its association with adjacent stations in a machine for manufacturing film.

During normal production, a cast web is orientation drawn or stretched in the machine direction (MD) and then in a transverse direction (TD) in what are referred to herein as stretching stations. In FIG. 1, the TD stretching station appears as a tenter oven 10 and a channel 12 for one of the tenter chains. The chains carry clips that grip the beads of a film 14 in its advance through oven 10. After ejection from the clips, film 14 is guided over transfer rolls 15–19. Between rolls 16, 17, the wide film is slit into plural films and two bead strips by plural knives, one of which is shown at 20. From roll 19, the two bead strips are routed to a full width shredder 22 and the slit films through nip rolls to as many windups.

Figure 2:
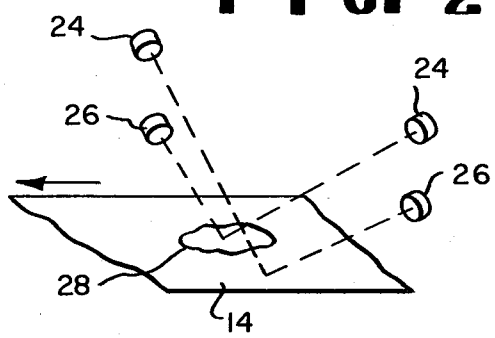
FIG. 2 is a schematic illustration of a photoelectric system for detecting discontinuities in a film.

At the output of oven 10, at each side of the path of advance for film 14 (FIG. 2), there is a light 24 and a photocell 26. This sensing system detects a break 28 in continuity. When such a break is detected, knives 20 are withdran and two additional knives 31 are inserted. As disclosed by Huskey, knives 31 traverse to the center of the film and are then withdrawn. In this manner, the full width of film 14 is diverted to shredder 22 until such time as the break 28 is healed and the film can again be slit and routed to the windups.

In the event of a malfunction at shredder 22, a wrap on any of rolls 15–19, breaks at both beads or a planned stoppage, controls for the apparatus of the present invention are actuated, either automatically or manually. Air from a first jet device 34 forwards the slack film from the tenter chains to the vicinity of a second jet device 36 which, with conveyor 32, routes the advancing film and any accumulation in the aisle in front of conveyor 32 through a converging chute 38 to a shredder 40. Air discharging through the inner wall of conveyor 32 and from slots in the upper end 41 of chute 38 direct the film to shredder 40. Excess air is exhausted through perforations in the lower end 42 of the chute. As noted, a typical event that actuates the controls automatically is the occurrence of breaks at both beads of the stretched film. The absence of beads is detected by sensors located on each side of the path of advance for film 14 downstream of roll 19, as shown at 44. If the film was not broken, as in a planned stoppage, shredder 40 breaks it without jerks or the like; eventually, before clearing rolls 15–19, any remaining length of film between conveyor 32 and roll 15 is cut by an operator as he crosses an aisle in front of conveyor 32.

Figure 5:
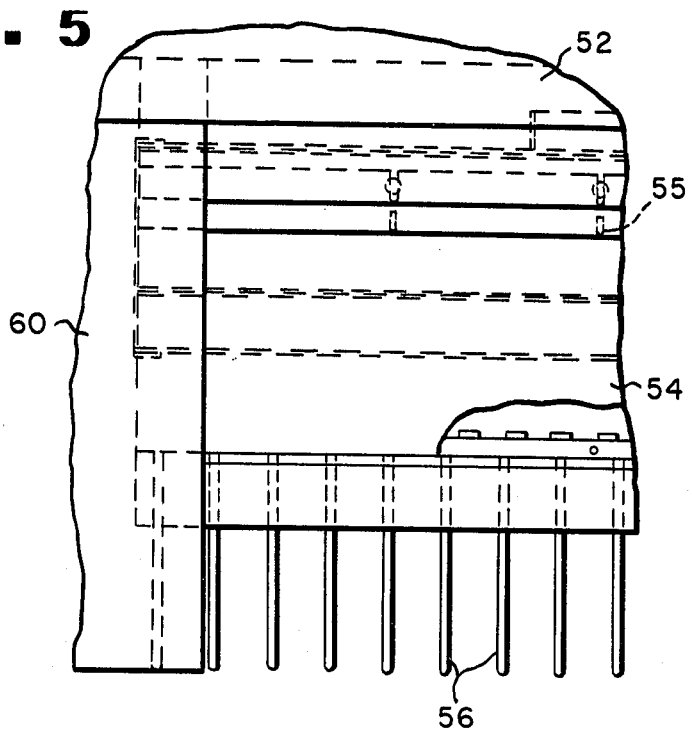
FIG. 5 is a fragmentary, top view of the forwarding apparatus.

Details of the jet device 34 are shown in FIGS. 3–5. It is located beneath the normal path of advance for film 14. Air under pressure is introduced to a plenum 46 through a duct 48 and a series of apertures 50. Air exits plenum 46 through a vaned, MD slot 51 between an angularly disposed plate 52 and a curved plate 54 that presents a Coanda surface. Vanes are shown at 55. The outlet of slot 51 is located just upstream of the point where the beads are released from the tenter clips. Plate 54 extends to a plurality of spaced rods 56. Excess air is exhausted through a plenum 57 below rods 56 and a duct 58. Jet device 34 is made in two, elongated sections that do not meet. A gap between the sections, at their inner ends, is covered by a plate 60 (FIGS. 4 and 5) that is bent into configuration with the upper surfaces of plates 52, 54 and rods 56. The space between rods 56 and jet device 36 is covered by a pivoted, access door 62 (FIG. 3).

Figure 8:
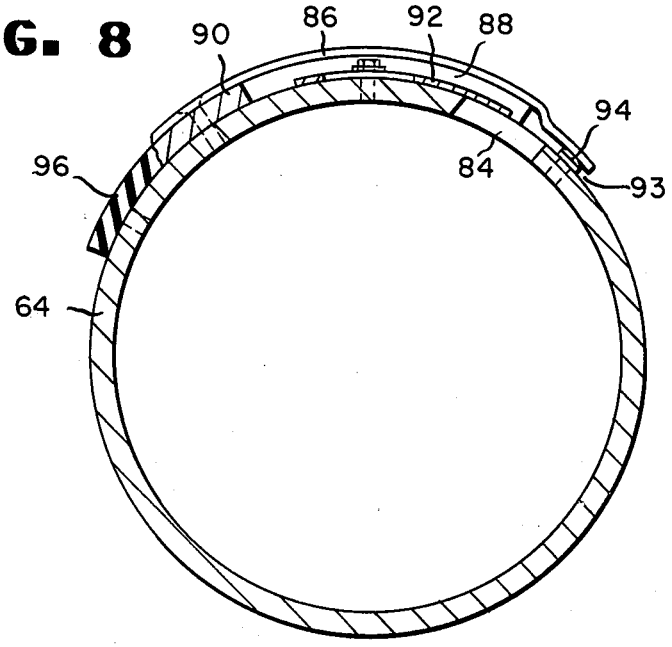
FIGS. 6–8 are elevational, top and sectional views, respectively, of the diverting apparatus shown in FIGS. 1 and 3, FIG. 8 having been taken on line VIII—VIII in FIG. 6.
Figure 7:
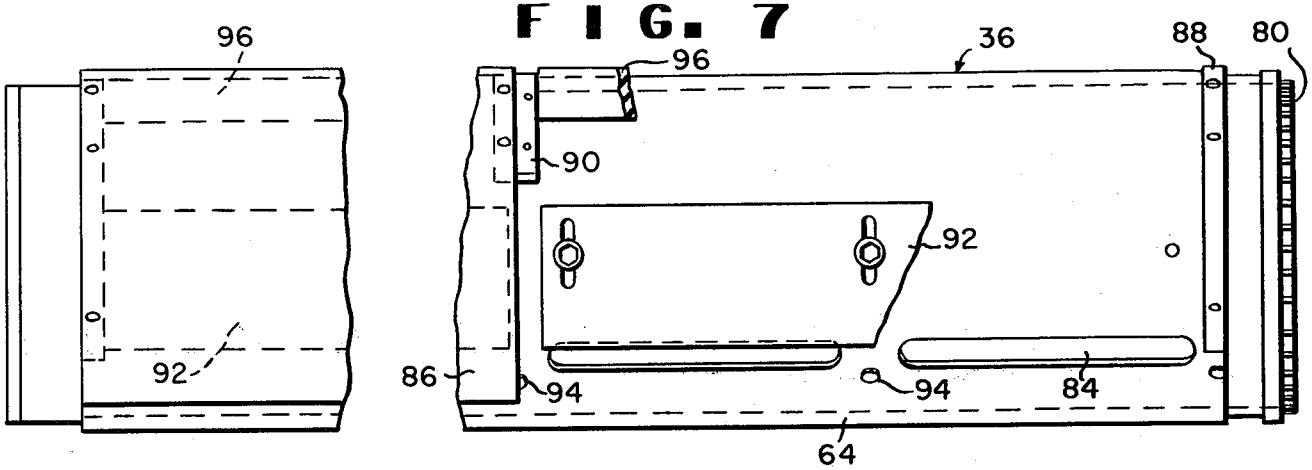
Figure 6:
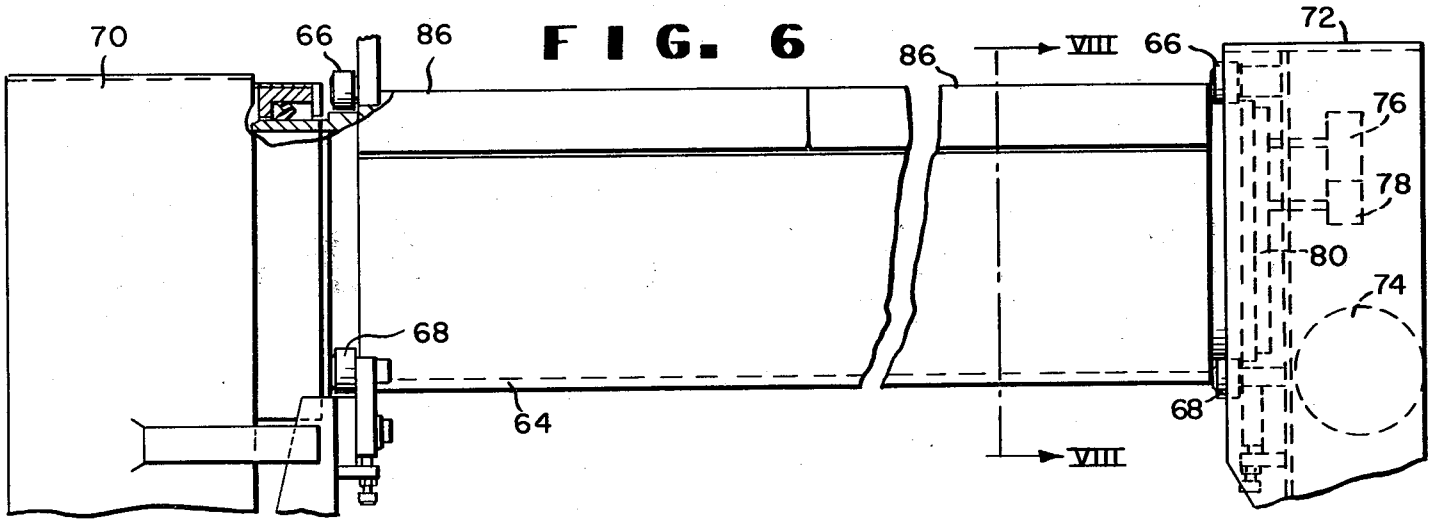
Figure 9:
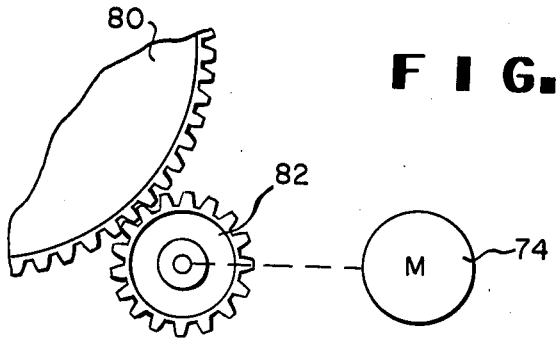
FIG. 9 is a schematic illustration of the geared drive for the tube shown in FIGS. 6–8.

Details of the jet device 36 are shown in FIGS. 6–9. In FIGS. 6, 7, it will be seen that a tube 64 is rotatably supported by upper and lower rollers 66, 68 which, in turn, are carried by either the frame of the machine or by end supports 70, 72. Tube 64 is located just downstream of exit sprockets for the tenter chains, i.e., where waste often accumulates. End support 70 has facilities for receiving air under pressure and discharging it into the open end of tube 64. End support 72 carries a drive motor 74 and limit switches 76, 78. Motor 74 is coupled to a ring gear 80 fastened to the closed end of tube 64 through a pinion gear 82 (FIG. 9). Switches 76, 78 are fixed on end support 72 and linked to gear 80; the switches function to limit the extent to which tube 64 can rotate in opposite directions.

As shown in FIGS. 7, 8, air is discharged from tube 64 through slots 84 to secondary plenums defined by a plurality of abutting cover plates 86. The cover plates 86 are attached to end and intermediate spacers 88, 90. Air flow from the slots 84 beneath the several cover plates 86 can be balanced by adjustments in the positions of curved, flow distribution plates 92.

As best shown in FIG. 8, the secondary plenums discharge onto the surface of tube 64 through a slot-jet 93 defined by the gap between the tube and the cover plates 86. That gap is set and maintained by the heads on a plurality of spaced drill bushings 94. The longitudinal gaps between spacers 88, 90 is filled by sealing strips 96.

Figure 10:
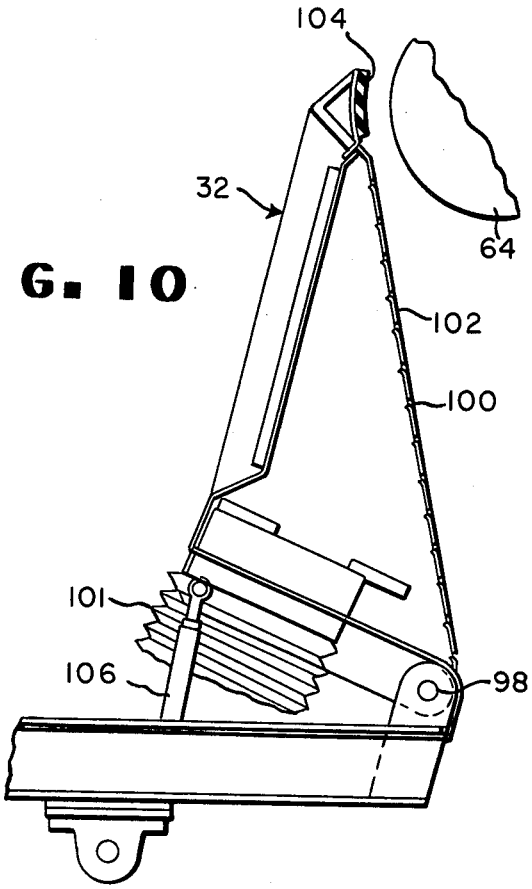
FIG. 10 is an enlarged view of the pivoted, pneumatic conveyor shown in FIGS. 1 and 3.

Referring to FIGS. 1, 3 and 10, conveyer 32 is a hollow door located at the entrance to chute 38. The door extends through the length of tube 64 and is pivotally mounted adjacent its ends, as shown at 98. The door is airtight except for an opening in its bottom wall and louvered slots 100 in its inner wall 102. Air under pressure is introduced through a hose 101. At its upper end, the door is provided with a resilient pad 104 that normally bears against tube 64. For the diversion of film, it is pivoted to the open position by actuators 106.

When there is a malfunction, for example, an absence of beads at location 44, control signals for the various elements disclosed herein are generated in the logic unit of a programmed controller. An operator is advised, by visible and audible signals, that the film 14 is broken between roll 15 and conveyor 32. Rolls 15–19 and the windups are stopped and conveyor 32 is opened. By this time, air under pressure has been introduced into jet devices 34 and 36 through valved connections. The advancing film is attracted to the foil surfaces of curved plates 54 by Coanda effects and forwarded thereby to the slipstream on tube 64, which diverts the film to chute 38. After diversion, tube 64 is rotated counterclockwise (FIG. 3), through an angle of about 100°, thereby moving slot-jet 93 below pad 104 on conveyor 32. Next, conveyor 32 is closed to a small gap with tube 64 and air to jet device 32 is shut off. Efficient diversions at line speeds have been achieved in this manner with the semi-automatic apparatus disclosed herein.

Normal production is resumed by first inserting a rail knife 108 (FIG. 1) into film 14 adjacent one of its edges. The resulting strip is cut manually and threaded over the rolls 15–19 to shredder 22. Then, air to jet device 36 is shut off and tube 64 and conveyor 32 are returned to their normal, starting positions. After a small time delay, in which a sufficient length of slack film is generated to reach shredder 22 in a double sheet, rail knife 108 is withdrawn. The leader strip then advances the entire film width in a double layer through rolls 15–19 to shredder 22. Thereafter, the steps disclosed by Hawkins in U.S. Pat. No. 3,764,085 are followed to establish continuity to the windups.

What is claimed as new and desired to be secured by Letters Patent is:

1. In film-handling equipment, an elongated Coanda jet located beneath the normal path of advance for film, means mounting the jet for rotation between a first position for picking up and diverting a broken film and a second position for advancing the film to waste, and an elongated forwarding jet located beneath and transversely of said path, in advance of said Coanda jet.

2. The equipment of claim 1 wherein said jet comprises an elongated, hollow element having a tubular surface and a slot-jet opening onto said surface.

3. The equipment of claim 2 further comprising a waste collector beneath said element.

4. In a machine including equipment for transferring film through a path of advance to a windup, an apparatus for diverting broken film, said apparatus comprising:

an elongated, hollow element having a tubular surface and a slot-jet opening onto said surface, said element being located beneath and adjacent said path with the slot-jet extending transversely through the width of the path;

a waste collector beneath said element; and means mounting said element for rotation about its axis between a normal first position in which the slot-jet is directed along said path and a second position in which it is directed toward the waste collector.

5. The installation of claim 4 wherein is provided an elongated forwarding jet located beneath said path, in advance of said element.

6. The installation of claim 5 wherein said forwarding jet comprises a pair of elongated plates extending transversely of said path, one plate having a curvilinear outer surface, the other plate having an edge spaced from said outer surface and defining therewith an orifice directed generally along said path.

7. The installation of claim 4 wherein is provided a conveyor between said hollow element and said waste collector, said conveyor including a door mounted for swinging movement toward and away from the element.

8. The installation of claim 7 wherein said door is provided with air flow means for directing film to said collector.

* * * * *